US006202328B1

(12) United States Patent
Fulton

(10) Patent No.: US 6,202,328 B1
(45) Date of Patent: Mar. 20, 2001

(54) REAR MOUNTED PLOW

(76) Inventor: Richard E. Fulton, 1556 Wellington Ave., Grand Junction, CO (US) 81501

( * ) Notice: Subject to any disclaimer, the term of this patent is extended or adjusted under 35 U.S.C. 154(b) by 0 days.

(21) Appl. No.: 09/228,334

(22) Filed: Jan. 11, 1999

Related U.S. Application Data

(60) Provisional application No. 60/071,093, filed on Jan. 9, 1998.

(51) Int. Cl.[7] ..... E01H 5/04

(52) U.S. Cl. ..... 37/231; 37/266

(58) Field of Search ..... 37/231, 219, 232, 37/266, 268, 269; 172/297, 684.5

(56) References Cited

U.S. PATENT DOCUMENTS

| | | | | |
|---|---|---|---|---|
| 1,020,727 | | 3/1912 | Sutcliffe . | |
| 3,755,930 | * | 9/1973 | Brandt et al. | 37/219 |
| 4,369,590 | | 1/1983 | Miller . | |
| 4,403,432 | | 9/1983 | Biance | 37/235 |
| 4,506,465 | * | 3/1985 | Johnson | 37/268 |
| 4,630,686 | * | 12/1986 | Ausmus, Jr. | 172/684.5 |
| 4,802,293 | * | 2/1989 | Smith | 37/268 |
| 4,907,357 | * | 3/1990 | Lilienthal | 37/266 |
| 5,046,271 | | 9/1991 | Daniels | 37/231 |
| 5,050,322 | * | 9/1991 | Burkard | 37/268 |
| 5,058,295 | * | 10/1991 | Holland | 37/268 |
| 5,136,795 | | 8/1992 | Rosenberg | 37/233 |
| 5,207,010 | * | 5/1993 | Grossman | 37/231 |
| 5,265,355 | * | 11/1993 | Daniels | 37/231 |
| 5,285,588 | | 2/1994 | Niemela et al. | 37/234 |
| 5,400,859 | | 3/1995 | Harrell | 172/219 |
| 5,411,102 | | 5/1995 | Nickels et al. | 172/781 |
| 5,485,690 | * | 1/1996 | MacQueen | 37/231 |
| 5,595,007 | | 1/1997 | Biance | 37/268 |
| 5,806,213 | * | 9/1998 | Doornek et al. | 37/231 |
| 5,806,214 | * | 9/1998 | Behrens et al. | 37/231 |

* cited by examiner

*Primary Examiner*—Robert E. Pezzuto
*Assistant Examiner*—Nathan Mammen
(74) *Attorney, Agent, or Firm*—Sheridan Ross P.C.

(57) ABSTRACT

A snowplow for towing by a vehicle wherein the snowplow can be manually raised to a non-plowing position, and lowered to a plowing position by a user applying leverage to a fulcrum. The snowplow blade is attached to the snowplow from the non-plowing side of the blade, thereby alleviating attachment obstacles that inhibit the flow of snow to the ends of the blade during operation. Additionally, the snowplow has a blade attachment that allows the blade to follow ground surface undulations that can, e.g., cause the blade to be at an angle to the horizontal during operation.

22 Claims, 15 Drawing Sheets

REAR MOUNTED PLOW

CROSS-REFERENCE TO RELATED INVENTIONS

This application claims the priority benefit of provisional U.S. Pat. application No. 60/071,093, filed Jan. 9, 1998.

BACKGROUND OF THE INVENTION

Various snowplows have been developed and marketed for attaching to vehicles such as cars and trucks. Typically, such plows are attached to the front of the vehicle, and are time-consuming to attach in that such plows: (a) are heavy and therefore require attachments to firm supports such as a vehicle's frame, (b) include electrical components such as motors, winches, and the like for raising and lowering the snowplow blade. Accordingly, a user must also electrically connect the snowplow to the electrical system of the vehicle in order to properly operate the snowplow.

Snowplows have also been developed for being towed behind a vehicle as well. In general, these snowplows have the same drawbacks as mentioned above for the snowplows intended to be attached to the front of a vehicle.

Accordingly, it would be desirable to have a snowplow that relieves a user of much of the burden of attaching and detaching snowplows from a vehicle typically used for other purposes than plowing snow. Thus, it would be desirable to have a snowplow that is also relatively lightweight, does not require electrical vehicle modifications and/or electrical attachments, and that is straight forward to both attach and detach to a vehicle.

SUMMARY OF THE INVENTION

The present invention is a lightweight, cost-effective snowplow that is easily attached to and detached from a vehicle. The snowplow of the present invention attaches to the rear of a vehicle for plowing while being towed. In one embodiment, the snowplow attaches to a vehicle's trailer hitch. An important aspect of the present invention is that the snowplow blade is capable of manually raised and lowered. Further, the raising and lowering of the blade are performed without undue stress on a user since leverage can be applied to these tasks by applying manual force to a fulcrum provided by the present invention for pivoting the snowplow blade between a raised position in which plowing is not performed, and a lowered position in which plowing is performed.

Additionally, it is an aspect of the present invention that the blade attachment for attaching the blade to the snowplow attaches to the rear or non-plowing side of the blade. This provides an added advantage in that the snow being plowed can more straightforwardly flow to the edges of the blade rather than accumulating on any blade attachments projecting from the plowing side of the blade. Thus, the present invention allows the plowed snow to flow to the edges of the blade without interruption. Accordingly, this aspect of the invention allows for less strain to be put on the snowplow and accordingly, makes it easier for the snowplow to be towed.

It is another aspect of the present invention that the snowplow blade may be attached to the snowplow in a manner that allows the blade to effectively plow snow over uneven terrain wherein one end of the snowplow blade is higher than the other end of the blade. That is, the blade is capable of adapting to ground surface undulations that can cause the blade to be at an angle to the horizontal.

Other aspects and features of the present invention will become evident from the detailed description and accompanying drawings provided herein.

BRIEF DESCRIPTION OF THE DRAWINGS

FIG. 15 shows the snowplow 20 in a transitional configuration that occurs when raising and/or lowering the blade 72.

DETAILED DESCRIPTION

Figure 1:
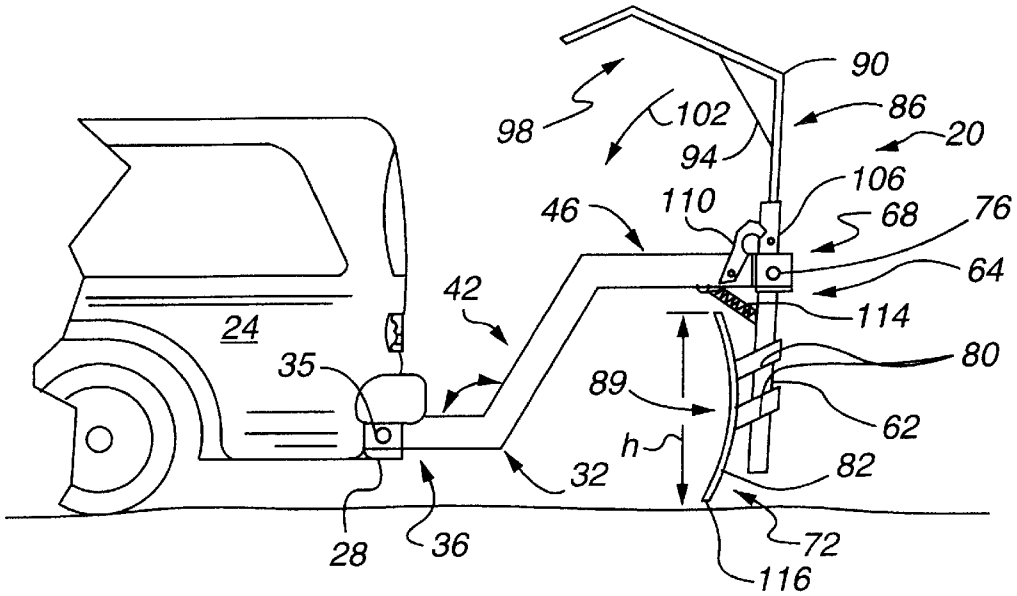
FIG. 1 shows a side view of the snowplow 20 of the present invention attached to the rear of a vehicle for being plowed, wherein the snowplow blade 72 is in a lowered position for thereby plowing snow.
Figure 2:
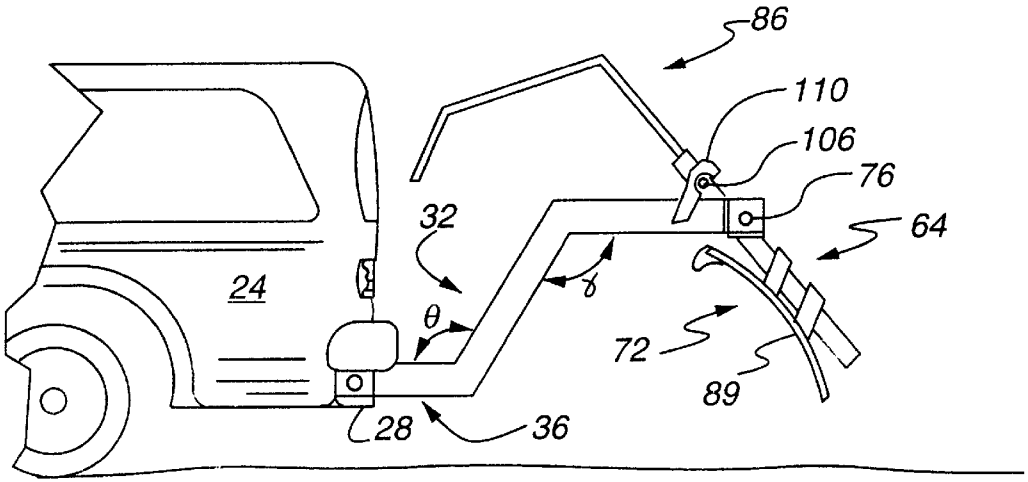
FIG. 2 shows the snowplow 20 with the snowplow blade 72 in a raised position wherein it is not used for plowing snow.

Referring to the FIGS. 1 and 2, a first embodiment of a snowplow 20 according to the present invention as shown. FIG. 1 shows the snowplow 20 mounted on the rear of a vehicle 24. The snowplow 20 is mounted on the vehicle 24 via a conventional trailer hitch sleeve 28 attached to the rear of the vehicle 24. Such trailer hitch sleeves 28 are typically tubular, and a free end of a support member 32 of the present embodiment of the snowplow 20 is shaped and sized so that it can be slidably received within the trailer hitch sleeve 28 such that the sleeve 28 and support member can be secured together by pin 36. The support member 32 includes a horizontal vehicle attachment portion 36, an upwardly-angled portion 42, and a plow assembly attachment portion 46. Note that the angle Θ (FIG. 2) between the vehicle attachment portion 36 and the upwardly-angled portion 42 may be substantially any angle between 15° and 165°. However, a preferred range is between 90° and 150°, and more preferably between 120° and 140°. In particular, it is believed that the more preferred angle range can provide an appropriate compromise so that the upwardly angled portion 42 rises steeply enough so that the snowplow 20 is not excessively long while at the same time providing adequate ground clearance for the blade 72 when in a non-plowing position such as in FIG. 2. That is, preferably the snowplow 20 is no longer than 10 feet. Furthermore, in one embodiment, the angle (FIG. 2) between the upwardly-angled portion 42 and the plow assembly attachment portion 46 is approximately identical to Θ. However, other angles within the ranges indicated for Θ above are also acceptable.

Note that the support member 32 does not attach to the front surface 89 of the blade as is typical in many prior art towed snowplow systems. Note that the plow assembly attachment portion 46 may be bifurcated at its free end 68 for receiving the pivotally-attached blade support 62 which is, in turn, part of the plow assembly 64 described in further detail hereinbelow. Also note that in the present embodiment, the free end 68 of the plow assembly attachment portion 46 is bifurcated sufficiently for both receiving the blade support 62 between the bifurcations, and allowing the blade support to be pivoted so that the plow assembly 64 can pivot between a raised position wherein the snowplow blade 72 is not capable of displacing snow (i.e. FIG. 2), and a lowered position (FIG. 1) wherein the blade 72 is capable of displacing snow. Further note that to provide such pivoting action of the plow assembly 64 between a raised and lowered position, the plow assembly is pivotally-attached to the free end 68 by a pin, bolt or shaft 76.

Figure 3:
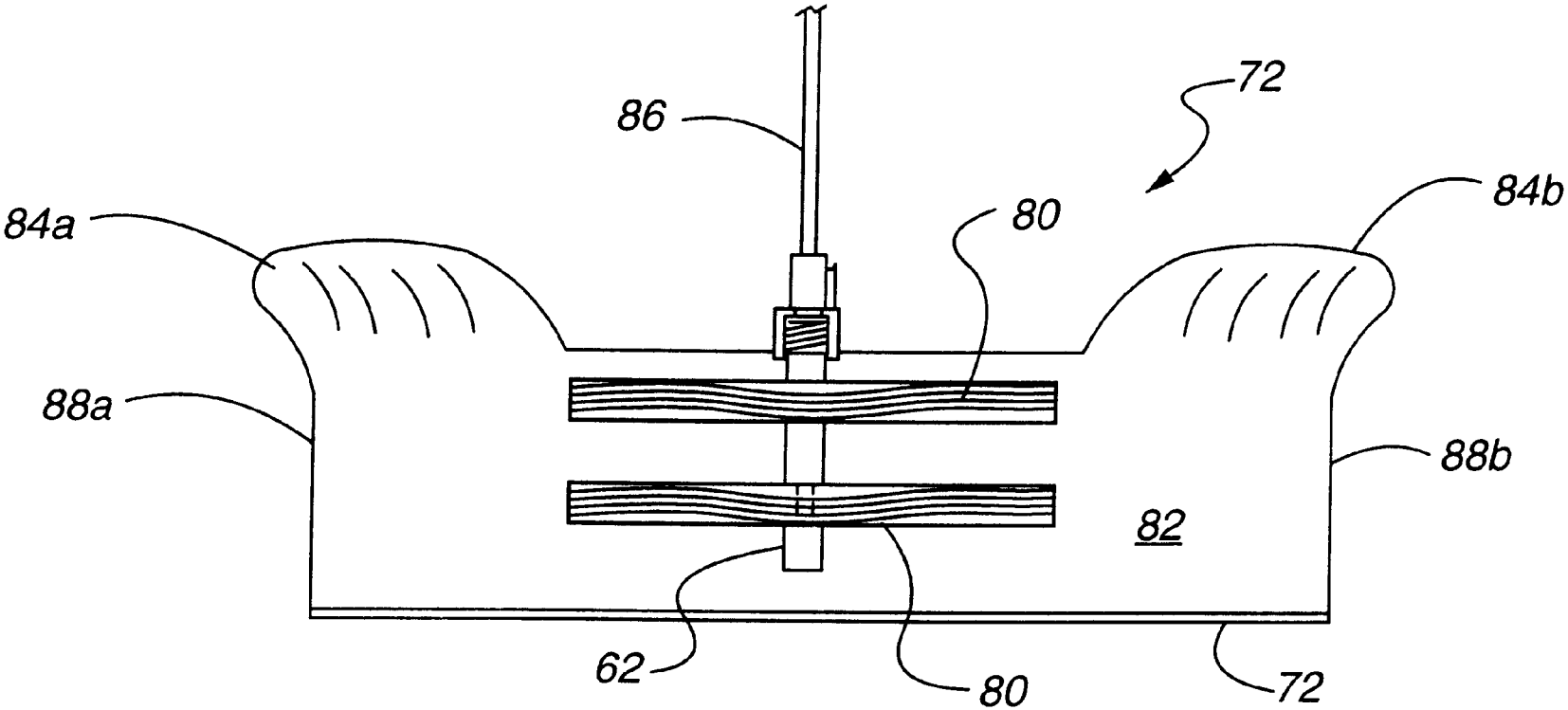
FIG. 3 shows the back or rear side of an alternative embodiment of the blade 72 for use in the snowplow of the present invention.

Returning now to the plow assembly 64, in addition to the blade support 64 and the blade 72, this assembly includes a means for securing the blade 72 to the blade support 62. Note that in FIG. 1, the blade 72 is attached to the blade support 62 by straps 80. The straps may be secured both to the back surface 82 of the blade 72 and the blade support 62. The straps 80 may be attached about the blade support 62 by rivets, bolts, welds, or alternatively, may be secured by extending through slots (not shown) piercing the blade support 62. The straps 80 can be composed of any rigid material. An example of such straps 80 are also illustrated in FIG. 3, wherein an alternative embodiment of the blade 72 is shown having flares 84*a* and 84*b* at the blade ends 88*a* and 88*d*. Of course, various other embodiments of the blade 72 is also within the scope of the present invention. In particular, snowplow blades that are "V"-shaped when viewed from above the snowplow 20 are also within the scope of the present invention.

It is an important aspect of the present invention that the plowing surface 89 of the blade 72 is free of supports for securing the blade 72 to the remainder of the snowplow 20. Thus, by having the surface 89 free of projecting supports, the snow being plowed more easily flows off to one side of the blade rather than accumulating thereon and potentially overflowing the blade or reducing plow effectiveness.

It is also within the scope of the present invention to attach the blade 72 to the blade support 62 by various other means. For example, flattened metal bars may be welded and/or riveted to both the back surface 82 of the blade 72 and the blade support 62. Additionally, other techniques may be used wherein the blade 72 is capable of conforming to different ground heights, for example, at opposite ends 88*a* and 88*b* of the blade 72 as will be discussed in detail hereinbelow.

Still referring to FIGS. 1 and 2, the plow assembly 64 further includes a fulcrum 86 attached to the end of the blade support 62 furthest from the blade 72. The fulcrum 86 has an elbow 90 with reinforcement 94 for reinforcing the fulcrum arm 98. When manual downward force is applied to the fulcrum arm 98 (generally in the direction of arrow 102), the plow assembly pivots about the shaft 76, thereby resulting in a raising of the plow blade 72. Note that the fulcrum 86 may take various forms and have a length effective for providing the leverage necessary for allowing a force in the range of 5 to 120 lbs. to be used in raising the blade 72 to a raised position as in FIG. 2. Further note that the fulcrum 86 is attached to the snowplow 20 in a manner so that it is above the pivot shaft 76, thus assuring an appropriate amount of leverage. Moreover, the fulcrum 86 may, in some embodiments, be telescoping and/or foldable for adjusting the length and/or configuration of the fulcrum for obtaining desired leverage appropriate to a user's height and strength. Additionally, by allowing the length of the fulcrum to be adjustable, the snowplow 20 can be stored more compactly than would otherwise be the case.

The plow assembly 64 also includes a latch shaft 106 to be used in combination with a latch 110 for securing the plow assembly in a raised position as in FIG. 2. Note that the plow assembly 64 is spring-biased to maintain the blade 72 in the lowered position of FIG. 1. That is, spring 114 connects between the plow assembly attachment portion 46 and the blade support 62 for maintaining the plow blade 72 in position for plowing snow. If an immovable object is contacted by the blade 72, then, however, it is an aspect of the present invention that the blade 72 will rotate counterclockwise, thereby raising the blade and disengaging from the immovable object.

Note that other means for biasing the plow assembly 64 toward the lowered position are also within the scope of the present invention. For example, compression springs about the shaft 76 may be used. Additionally, in some embodiments, such biasing means may be included in the attachment of the blade 72 to the blade support shaft 64. Moreover, such biasing means may function in combination with breakaway lower edge 116 to reduce the likelihood of the blade 72 being damaged if an immovable object is contacted during plowing. Furthermore, in some embodiments of the present invention, the spring 114 (or other biasing mechanisms) can be unhooked or disengaged prior to a user manually exerting force on the fulcrum 86 to raise the plow assembly 64.

Thus, in operation, a user desiring to use the snowplow 20 of FIGS. 1 and 2 can insert the free end of the horizontal vehicle attachment portion 36 into a trailer hitch sleeve 28 and secure these two components together via, for example, a pin 36. Assuming the plow assembly 64 is initially in the lowered position and that the plow assembly biasing mechanism (e.g. spring 114) is appropriately attached for biasing the plow assembly 64 to the lowered position, the user can commence towing the snowplow 20 with the vehicle 24. When it is desirable to raise the plow assembly 64, however, the user can manually exert force on the fulcrum 86 (possibly after disengaging the plow assembly biasing mechanism).

Figure 4:
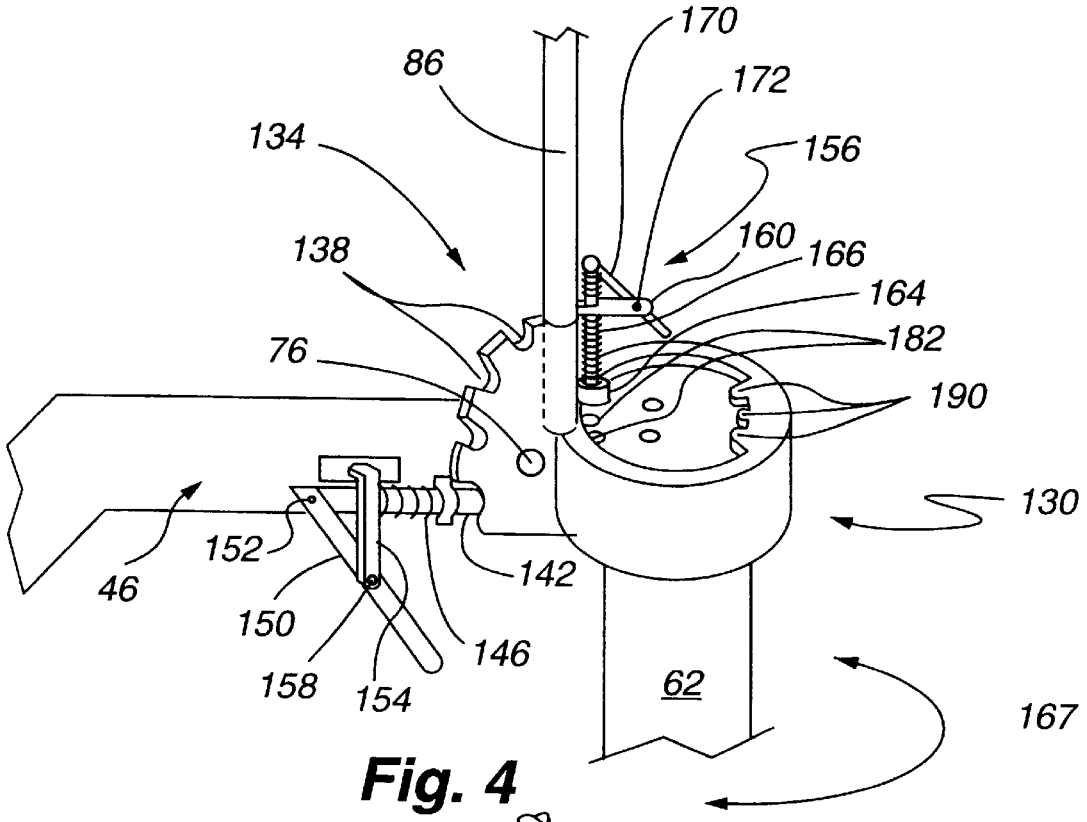
FIG. 4 shows a perspective view of the raising assembly 134 that pivotally attaches the blade 72 and its blade support 62 to the remainder of the snowplow 20.
Figure 5:
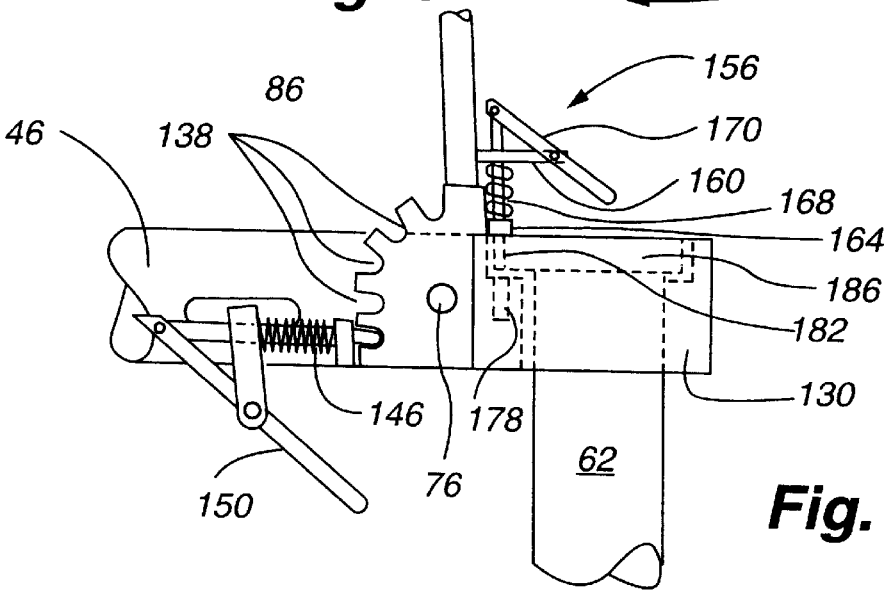
FIG. 5 shows a side view of the raising assembly 134.

There are a number of other embodiments of the present invention and/or components thereof which provide a fuller appreciation for the scope of the present invention. For example, FIGS. 4 and 5 illustrate an alternative embodiment for the latch 110 and the shaft 106. In the embodiment of these figures, the blade support 62 is secured within a collar 130, the collar being part of a raising assembly 134 that is pivotally-secured to the plow assembly attachment portion 46 via shaft 76. The raising assembly 134 includes one or more detentes 138 into which a dog 142 can be inserted, the dog being biased by a spring 146 toward the detentes 138, as one skilled in the art will understand. Note that since a lever 150 is pivotally attached to both the dog 142 (via pivot pin 152) and to arm 154 (via pivot pin 158), the lever 150 can be rotated clockwise to disengage the dog 142 from one of the detentes 138 when the user desires to pivot the blade support 62 (and the attached blade 72, not shown in FIG. 4). For instance, such pivoting of the blade support can be performed by manually exerting force on the fulcrum 86 as described hereinabove referring to FIGS. 1 and 2. Thus, in the embodiment of FIGS. 4 and 5, the blade support 62 and the blade 72 can be locked into a plurality of positions depending on which detente 138 the dog 142 enters. Thus, for high snow packs, the blade 72 can be positioned at an intermediate height between the fully-raised and fully-lowered position so that the snow can be plowed in layers if desired. Moreover, as mentioned above, the connection between the blade 72 and the blade support 62 can be in a flexible manner so that the blade 72 can plow with its blade ends 88*a* and 88*b* (e.g. FIG. 3) at different heights, and additionally so that the blade can flex to avoid damage if an immovable object is encountered.

Figure 6:
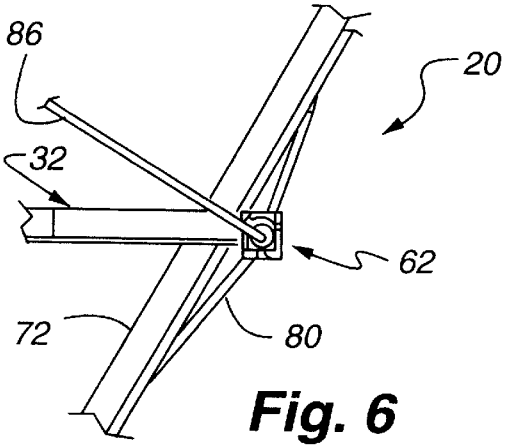
FIG. 6 shows a plan view of the snowplow 20 with the blade 72 in an angled position with respect to the towing direction 85.

The embodiment of FIGS. 4 and 5, also allows the blade support 62 to be rotated within the collar 130. More particularly, a spring-biased dog assembly 156 fixedly attached to, for example, the fulcrum 86 and/or the raising assembly 134 (via arm 160 and annular stay 164) secures the blade support 64 in a desired angular orientation (by the biasing spring 166) so that the blade support cannot rotate within the collar 130 in the directions of arcuate double-headed arrow 167. That is, the dog 168 (best shown in FIG. 5) can be manually inserted into both a bore 178 within the collar 130 and one of the recesses 182 (and/or bores) within the expanded diameter head 186 of the blade support 162. Additionally, the dog 168 can be manually retracted from the bore 178 and one of the recesses 82 by having the user rotate the lever 170 clockwise about the pivot point 172 pivotally connecting arm 160 and lever 170. Accordingly, when the dog 168 is retracted, the blade support can be rotated angularly as indicated by the double-headed arrow 167. Thus, since there are a plurality of bores 182 spaced about the perimeter of the expanded diameter head 186, the blade support 62 and, more importantly, the attached blade 72 can be aligned at various angles to the direction of travel of the vehicle 24. Note that FIG. 6 shows a top view of the blade 72 secured in such an angled position.

Figure 7:
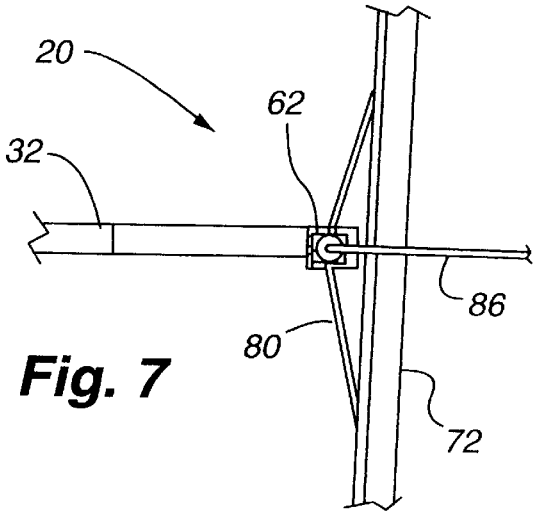
FIG. 7 shows the blade 72 rotated into a reverse position, wherein the snow-plowing face or surface is reversed and faces away from the rear of the vehicle 24 (not shown here). Accordingly, configuration of the present Figure., the snowplow 20 can be pushed by the vehicle to which it is attached moving in reverse and thereby traveling in a direction according to arrow.

Additionally, note that the expanded diameter head 186 includes recesses 190 similar to the recesses 182. The recesses 190 allow the blade support 62 and the attached blade 72 to be secured in the collar 130 so that the blade 172 is reversed (or substantially so) from the position shown in FIG. 1. Accordingly, in this reversed position a user can drive the vehicle 24 in reverse to push the snowplow 20 a short distance. Note that FIG. 7 shows a top view of the blade 72 secured in a reversed position.

Figure 8:
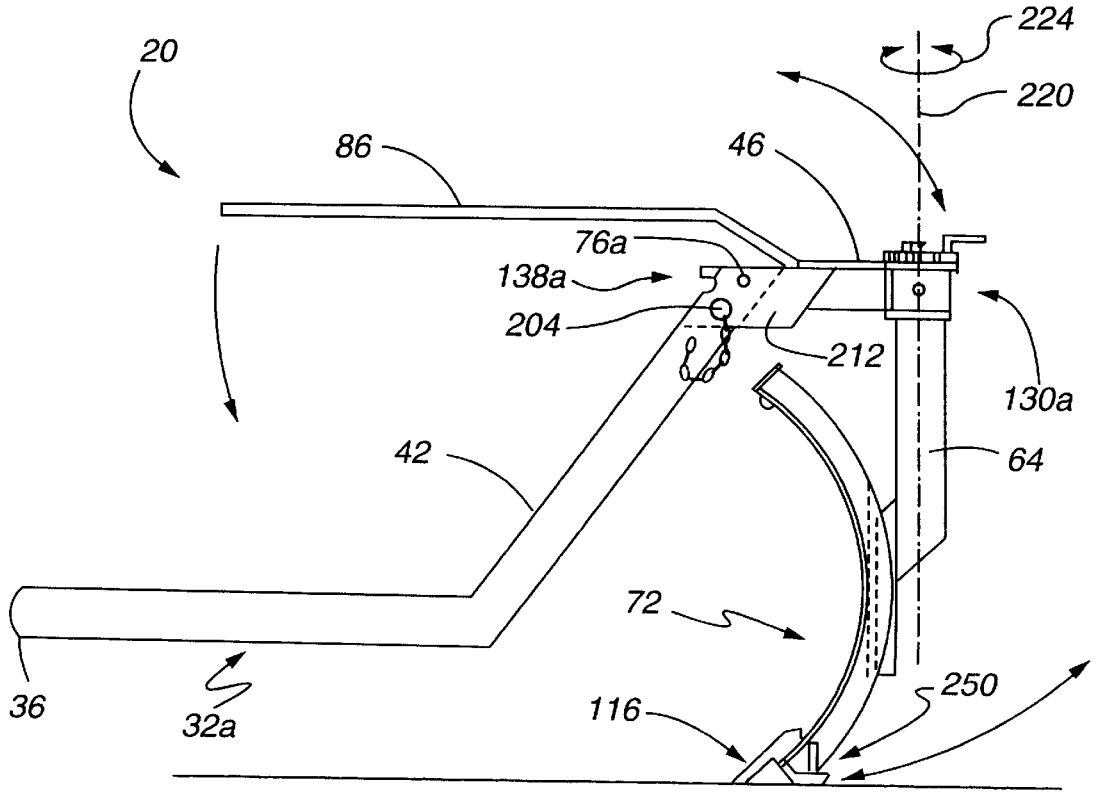
FIG. 8 shows a side view of an alternative embodiment of the snowplow 20 of the present invention.

FIG. 8 shows another embodiment of the present invention wherein components having similar or identical structure and functionality to those components in previously described embodiments have identical numerical labels for identification. Accordingly, the description of such components is not duplicated further in the embodiments provided hereinbelow. However, a number of distinctions are noteworthy in the embodiment of FIG. 8. In particular, note that the raising assembly 134*a* is now positioned at the joint between plow assembly attachment portion 46 and the upwardly angled portion 42. Further, note that the fulcrum 86 is now substantially horizontal when the blade 72 is in the lowered position.

Figure 9:
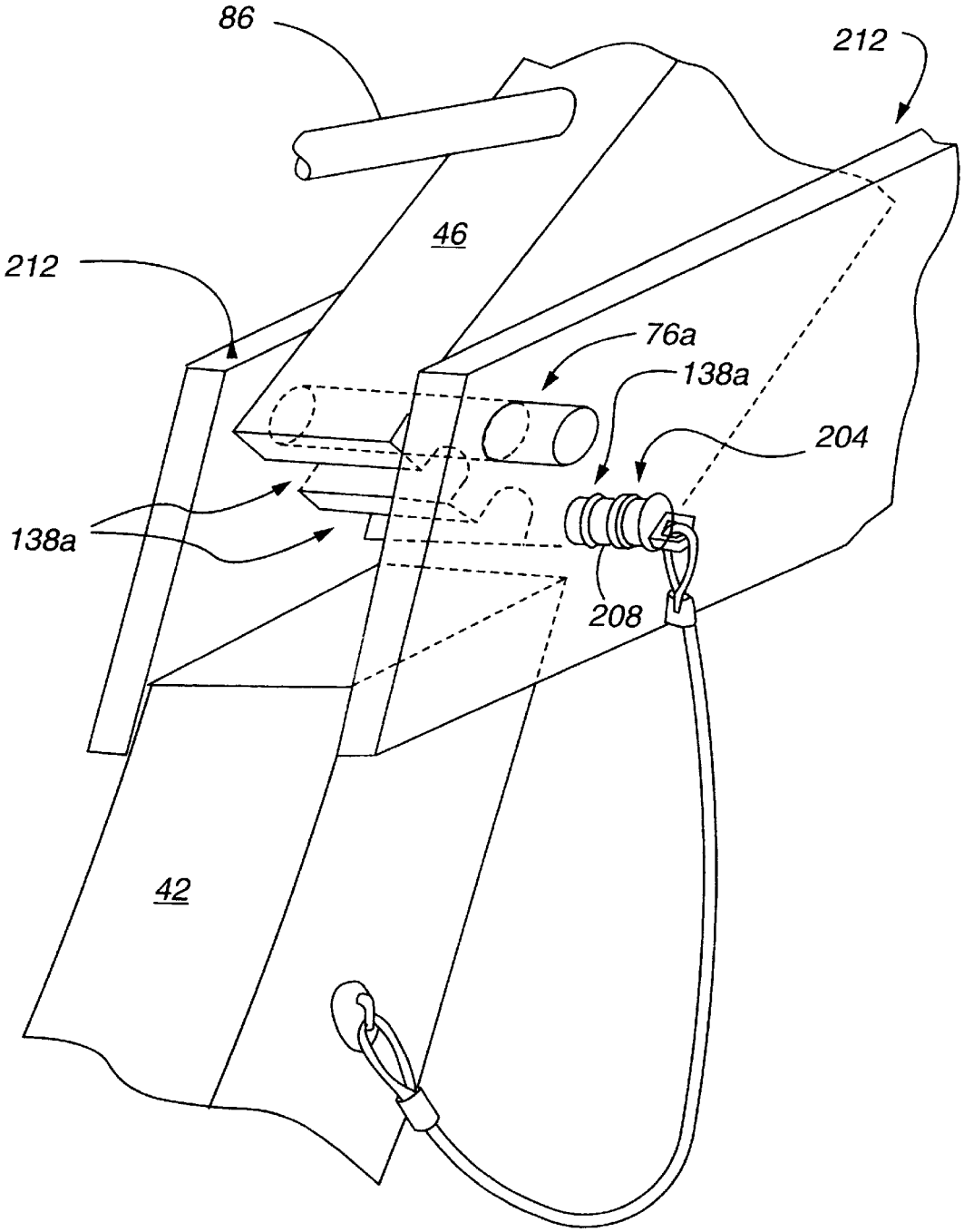
FIG. 9 provides additional detail for the snowplow blade raising and lowering pivoting mechanism that is incorporated into the embodiment of the snowplow shown in FIG. 8.

A more detailed view of the raising assembly 134*a* is provided in FIG. 9 which shows the plow assembly attachment portion 46 secured in an upwardly-angled orientation. That is, this Figure shows the attachment portion 46 pivoted about the shaft 76*a* so that one of the detentes 138*a* receives a shaft 204 that is horizontally provided through the bores 208 of the vertical parallel support plates 208 fixedly attached to the upwardly-angled portion 42 (only one such bore 208 being shown herein). Moreover, the shaft 204 can be removed from the support plate bores 208 so that the attachment portion 46 (and the blade 72) can be raised or lowered as desired and the shaft 204 can be then reinserted into the bores 208 and one of the detentes 138*a* aligned with these bores.

Figure 10:
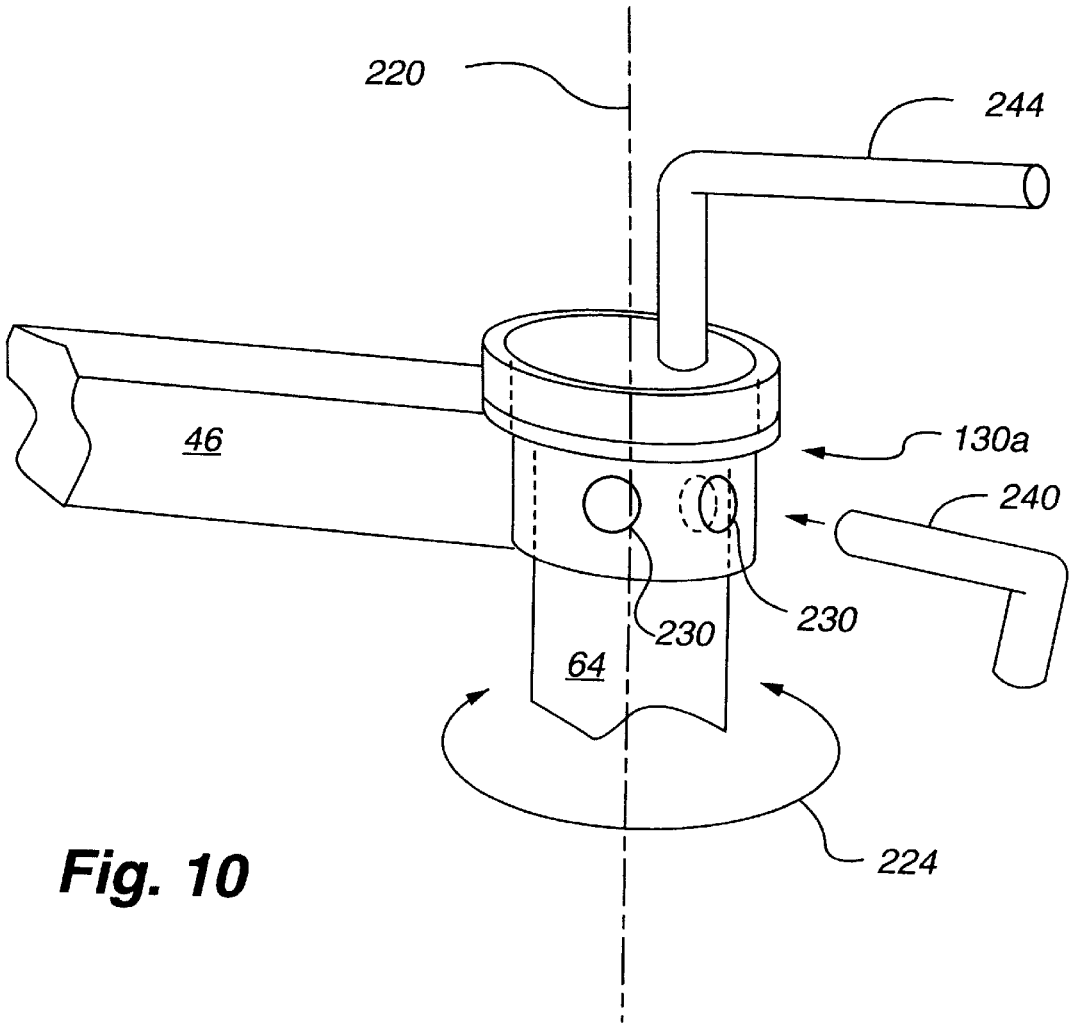
FIG. 10 shows additional detail for a collar 130*a* that allows the blade 72 to be rotated about a vertical axis when the blade 72 is in a lowered position for lowering snow.

Referring again to FIG. 8, note that the blade support 62 is held within a collar 130*a* so that the blade support 62 can be rotated about the axis 220 as indicated by the double-headed arcuate arrow 224. A more detailed view of the collar 130*a* and related components is provided in FIG. 10. Thus, as can be seen in this FIG., the collar 130*a* has a plurality of angle-fixing bores 230 for receiving a shaft 240. There is a bore (not shown) through the blade support 64 that can be aligned with any one of the bores 230 by rotating the blade support 64 (about the axis 220 according to double-headed arrow 224) via, for example, the lever 244. The bore through the blade support is approximately the same diameter as the bores 230 so that the shaft 240 can be inserted into (and possibly through) the bore of the blade support 64 to thereby secure the blade support (and the blade 72) in a desired angular orientation relative to the direction that the snowplow 20 is towed. Additionally, as one skilled in the art will understand, there may be one or more lips, rings, washers, etc. for securing the blade support 64 within the collar 130*a* so that the blade support cannot inadvertently unseat from the collar 130*a* in the directions coincident with the axis 220.

Figure 11:
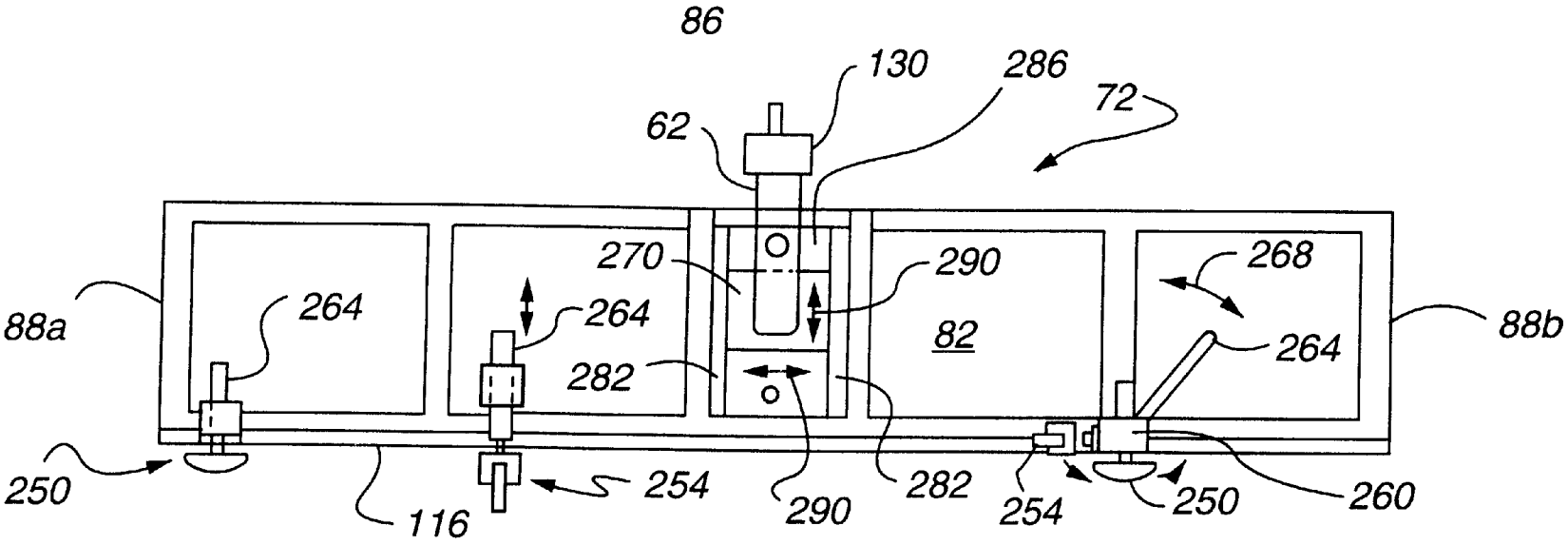
FIG. 11 shows the rear or back side of the blade 72 together with the blade support 62 attached thereto in a manner that allows for the blade 72 to follow an uneven contour of the terrain being plowed so that the ends of the blade 88*a* and 88*b* may be at different elevations. Further, note that this FIG. also shows various wheel and/or skid assemblies for maintaining the breakaway lower edge 116 of the blade a small distance above the ground.

Referring again to FIG. 8, note that attached to the blade 72 are adjustable skids 250 that may be used for two purposes. First, the skids 250 (spaced across the bottom edge of the blade 72) allow a user to more easily drag and/or position the snowplow 20 appropriately for attaching to a trailer hitch sleeve 28 as illustrated in FIGS. 1 and 2. Further, the skids 250 can be used to adjust the height of the blade and the breakaway lower edge 116 from the ground to therefore reduce the likelihood of the breakaway lower edge 116 being damaged by uneven ground being plowed. Additionally, note that skids 250 may be augmented or replaced by wheels to accomplish substantially the same purpose. FIG. 11 shows the backside of a blade 72 with various exemplary embodiments of skids 250 and wheels 254 that can be provided with an embodiment of the present invention. Further, skids 250 and wheels 254 may be provided in a single assembly as, for example, as illustrated by assembly 260 of this FIG. Thus, a plurality of the skids 250, wheels 254 and/or assemblies 260 may be spaced along the edge of the blade 72 having the breakaway lower edge 116. Preferably, at least two of the components 250, 254, and 260 are provided along this edge. Further, note that each of these components may be adjustable to vary the height of the ground of the breakaway lower edge 116. In particular, the skids 250 and the wheels 254 may have threaded shafts for adjusting ground clearance by the breakaway lower edge 116. Note that the assembly 260 can be particularly advantageous in that this assembly contains both a wheel 254 and a skid 250, wherein a user may apply manual force to the lever 264 in one of the directions of arcuate double-headed arrow 268 for switching between the wheel 254 and the skid 250. Accordingly, a user may utilize the wheels 254 for transporting and aligning the snowplow 20 with the rear of a vehicle 24 for attaching thereto, and subsequently, manually pivoting the levers 264 so that the skids 250 are positioned for contacting the ground and the wheels 254 are free from ground contact as illustrated in the configuration of the assembly 260 in FIG. 11. Additionally, when the user has finished plowing, he/she can reverse the levers 264 to again provide ground contact with the wheels 254 to thereby allow the snowplow 20 to be rolled on the wheels 254 to, for example, a user-desired storage area.

Further, the skids 250 may be elongated or regular in shape and may have relatively flat, concave, or convex bottom (not shown). In an alternative embodiment of the assembly 260 (not shown), this assembly may be oriented so that the pivoting axis is at a more or less right angle to the view shown in FIG. 11. Additionally, the assembly 260 may be actuated by simple friction; i.e., the skids 260 may be deployed when the blade 72 travels in a plowing direction, and the wheels deployed when the blade travels in a non-plowing or reverse direction.

Figure 12:
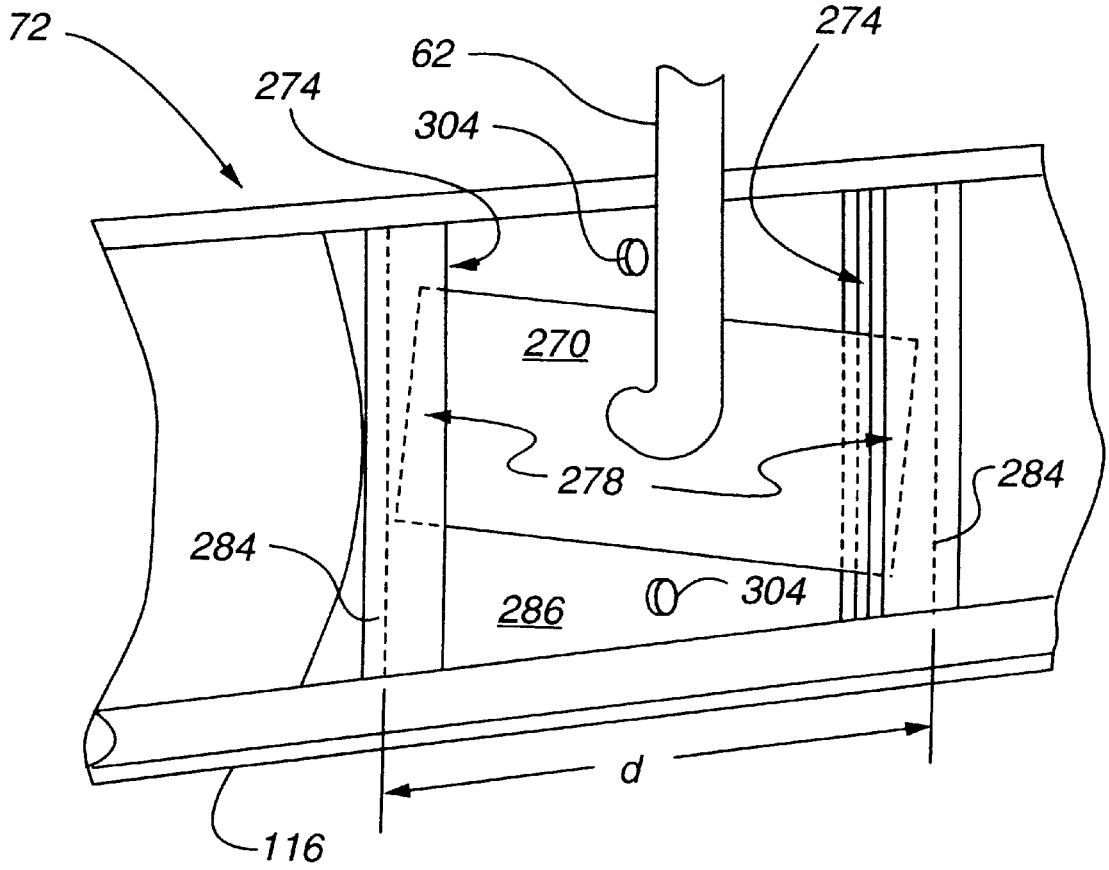
FIG. 12 shows a more detailed view of the attachment between the blade support 62 and the blade 72 as also shown in the embodiment of FIG. 11.

FIG. 11 also illustrates another important aspect of the present invention referred to hereinabove as the ability for the blade 72 to plow with its ends 88*a* and 88*b* at different heights such as with one of the ends on a curb and the other end at street level. This variable aspect of the blade 72 is provided by the attachment of the blade 72 to the blade support 62. In particular, the blade support 62 is attached to a plate 270 and the plate 270 is provided within slots 274, one such slot for retaining each of the vertical ends 278 of the plate 270. In particular, the retaining members 282 provide the outside wall to the slots 274 for retaining the plate 270 against a substantially planar backing surface 286. Moreover, as best seen in FIG. 12, the slots 274 are deep enough so that the distance d between the interior stops 284 of the slots 270 is greater than the horizontal extent of the plate 270. Thus, although the plate 270 is retained within the slots by the retaining members 282, the blade 72 is able to move relative to the plate 270 in the directions indicated by the double-headed arrows 290, 294 (FIG. 11). Thus, the play between the plate 270 and the distance d between the slot interior stops 284 allows for the ends of the blade 88*a*, 88*b* to be at different heights from the ground, since the vertical ends 278 of the plate 270 can be angled to the interior stops 284 as, for example, shown in FIG. 12. Additionally, note that there are vertical stops 304 provided on the planar backing surface 286 for limiting the extent of relative vertical movement between the blade 72 and the plate 270. Thus, it is unlikely that the plate 70 can become wedged in an angled position relative to the interior stops 284 that would not allow the blade 72 to return to a position that freely follows the contours of the ground.

Figure 13:
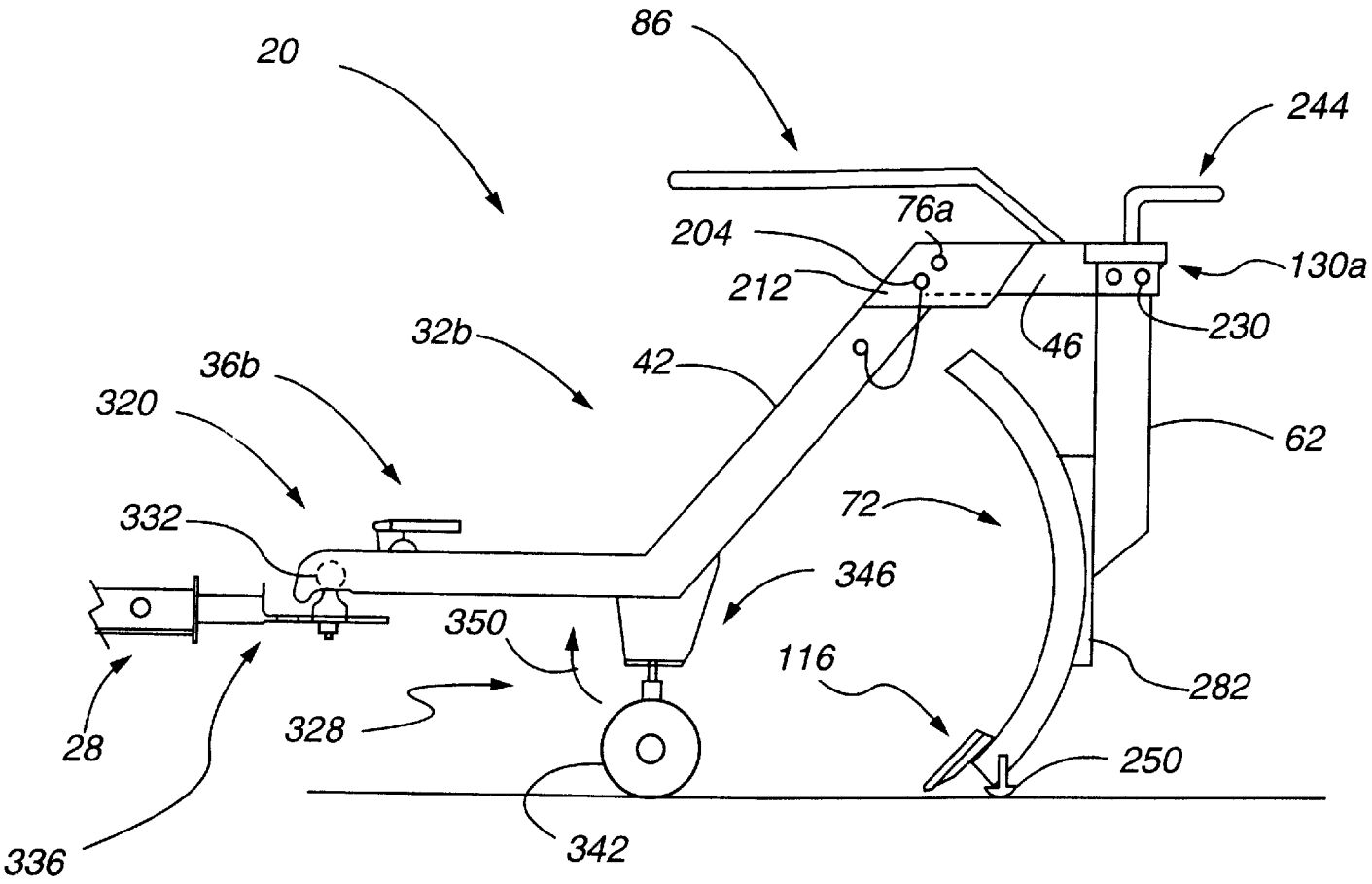
FIG. 13 shows another embodiment of the snowplow 20 of the present invention, wherein a standard trailer hitch and wheel assembly is incorporated into the snowplow.

FIG. 13 illustrates another embodiment of the present invention that is substantially similar to the embodiment of FIG. 8, and accordingly, components having similar structure and function have the numeric portions of their labels identical. The primary novel aspects of the embodiment of FIG. 13 includes the providing of a trailer hitch 320 at the free end of the horizontal vehicle attachment portion 36*b*, and a wheel assembly 328. Referring first to the trailer hitch 320, the hitch is of a ball-and-socket type, wherein the trailer ball 332 is fixedly attached to a trailer hitch adapter 336 that can be inserted into the trailer hitch sleeve 28. Thus, in the present embodiment, the snowplow 20 can follow the vehicle 24 and pivot on the trailer ball 332 when the vehicle 24 turns.

Referring now to the wheel assembly 328, this assembly includes at least one tire 342 (and possibly additional tires aligned with the tire 342 shown in FIG. 13). Additionally, a wheel attachment assembly 346 provides the attachment of the one or more tires 342 to the snowplow 20 so that these tires can support at least a portion of the snowplow 20 when a user is, for example, attaching or detaching the snowplow 20 to/from the trailer hitch adapter 336. Note that various embodiments of the wheel assembly 328 can be provided with the snowplow 20. In some embodiments, the one or more tires 342 may be fixedly oriented so that the tire(s) 342 are fixed in their directional orientation. Alternatively, the wheel assembly 328 may be capable of tracking the turning movements of the vehicle 24. Further, note that in some embodiments, the wheel attachment assembly 346 may be such that the tires 342 can be pivotally disengaged from the ground by rotating the tire(s) in the direction of arrow 350. Thus, a user can manually position the snowplow 20 for attaching to the trailer ball 332 with the wheel assembly 328 in the position shown in FIG. 13, and once the snowplow 20 is appropriately attached, then the tire(s) 342 may be retracted by, for example, manually disengaging a securing pin or shaft (not shown) and pivotally rotating the tire(s) 342 to a retracted position and then resecuring the tires in the retracted position using this same pin or shaft.

FIGS. 14–17 show yet another embodiment of the present invention. In particular, referring to FIG. 14, the embodiment of the snowplow 20 illustrated here has the blade 72 in a raised position. Note that in this embodiment the plow assembly 64 is attached to an end of a pivotal support assembly 404, wherein this assembly pivots about shaft 408 that is secured to the support member 32c. Additionally, note that the opposite end of the pivotal support assembly 404 includes a wheel assembly 328 which supplies support and ease of transport of the snowplow 20 when in the raised configuration of FIG. 14. Further note that a latch (not shown) can be provided for securing the pivotal support assembly 404 in the substantially vertical position of FIG. 14 for assisting in ease of transport manually by the user or when being towed behind vehicle 24 (not shown) between sites to plow.

Figures 14, 15:
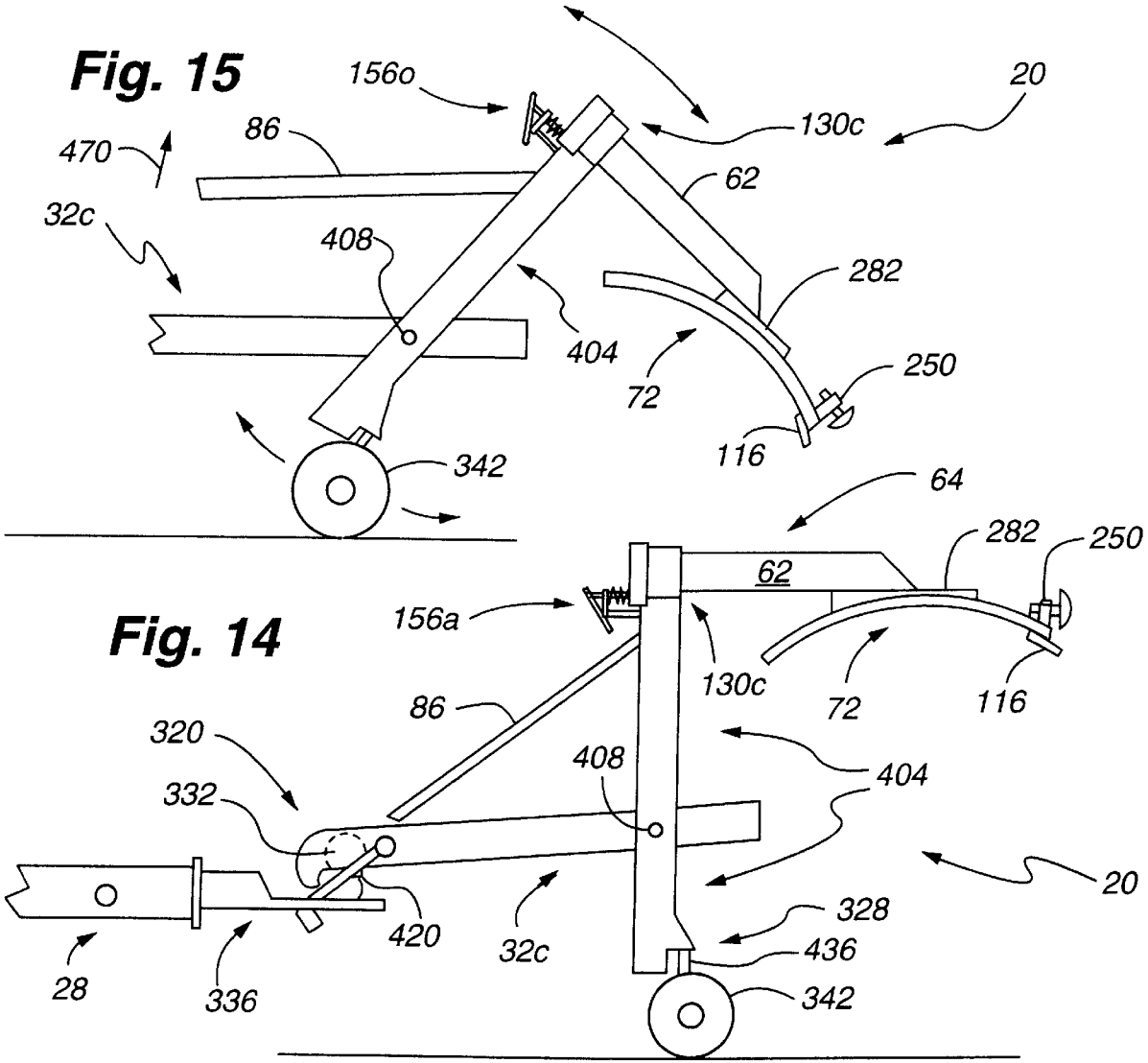
FIG. 14 shows yet another embodiment of the snowplow 20 of the present invention, wherein the blade 72 and a wheel assembly are at opposite ends of a pivotal support assembly 404 so that the snowplow 20 substantially rests on the wheel assembly when the blade 72 is in a raised, non-plowing position.
FIG. 15 shows another configuration of the embodiment of the snowplow 20 also presented in FIG. 14. In particular.

FIG. 14 also illustrates enhancements to the trailer hitch 320 for securing the snowplow 20 to the trailer hitch adapter 336. In particular, hooked stays 420 are provided wherein the hooked stays have one end fastened to the support member 32c and an opposite end capable of being inserted through a slot 456 (FIG. 17) in the trailer hitch adapter 336 for providing an additional mechanism for securing the snowplow 20 to the trailer hitch adapter 336.

The purpose of the hooked stays 420 is to decrease or limit the side-to-side movement of the snowplow 20. Since the snowplow 20 is attached to a trailer hitch ball in this embodiment, the hooked stays 420 prevent the snowplow 20 from drifting one side when plowing in a forward direction, and also prevent the snowplow from jack-knifing when the vehicle 24 travels in a reverse direction. Note that commercially available torsion bars, anti-sway bars, or other means, including a link of chain attached to the vehicle 24 and to the snowplow blade 72 may also be used to prevent such undesirable side-to-side movement of the snowplow. Additionally, a vertical plate (not shown) attached near the free end of the support member 32c so that this plate is in close proximity of the rear edge of the trailer hitch adapter 336 can also function to inhibit the undesirable side-to-side movement of the snowplow 20.

Figure 17:
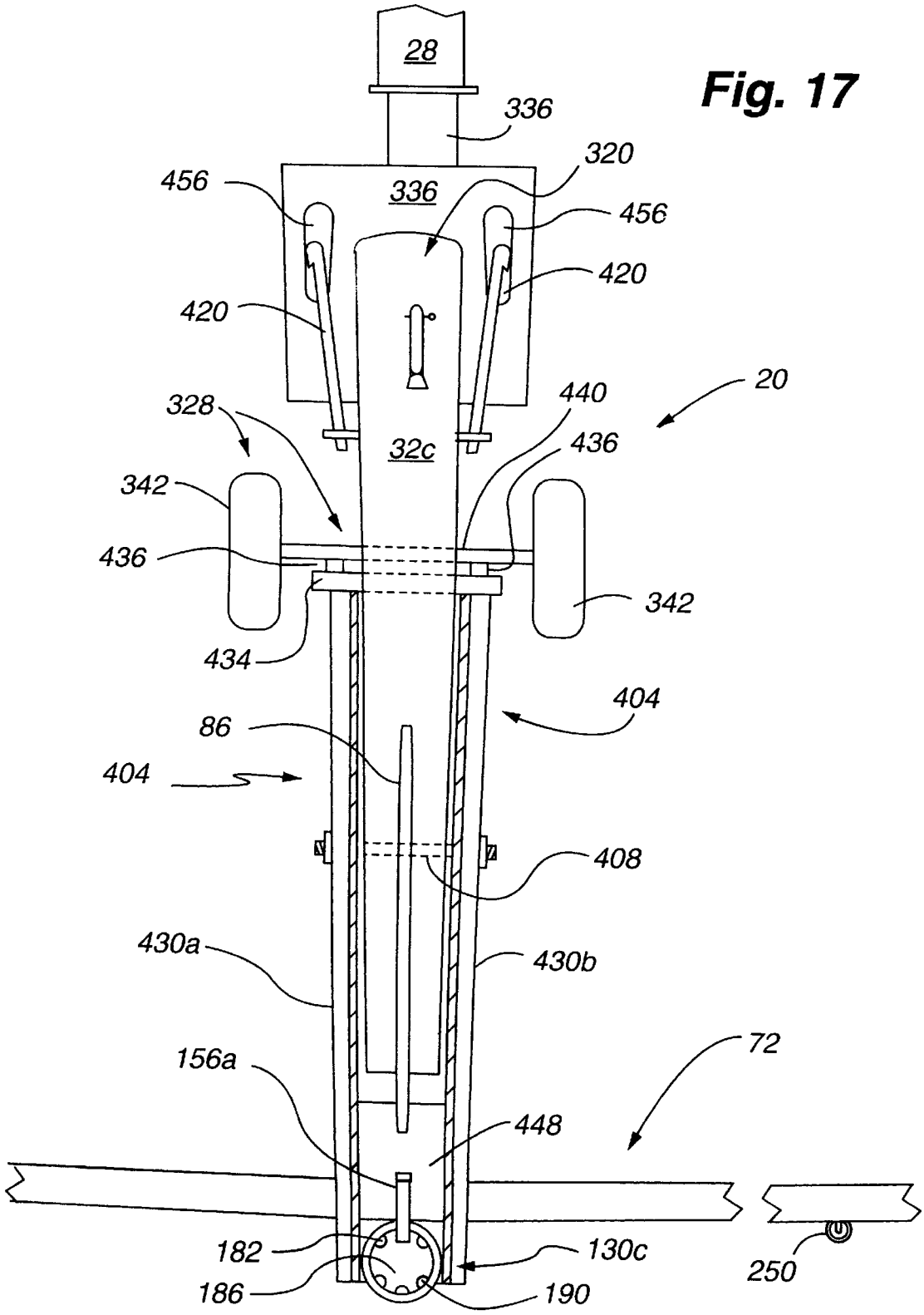
FIG. 17 shows a detailed plan view of the embodiment of the snowplow 20 provided in FIGS. 14–16.

FIG. 17 provides a top-view of the embodiment of the snowplow 20 of FIG. 14. Note that the pivotal support assembly 404 includes side supports 430*a*, 430*b* pivotally connected to support member 32*c* by shaft 408. Additionally, pivotal support assembly 404 also includes a lower cross-member 434 that connects the ends of the side supports 430*a*, 430*b*. The lower cross-member 434 may also be used for attaching the wheel assembly 328 to the remainder of the snowplow 20. That is, in the present embodiment, attaching bars 436 connect between the lower cross-member 434 and an axle 440 that connects between the tire assemblies 342.

The pivotal support assembly 404 also includes an upper cross-member 448 that also connects between the side supports 430*a*, 430*b*. Additionally, note that the upper cross-member 448 provides the attachment for the fulcrum 86 and the spring-biased dog assembly 56*a* that is substantially identical to the spring-biased dog assembly 56 in FIG. 4 with the exception that this assembly is stand-alone and not connected to, for example, the fulcrum 86.

Figure 16:
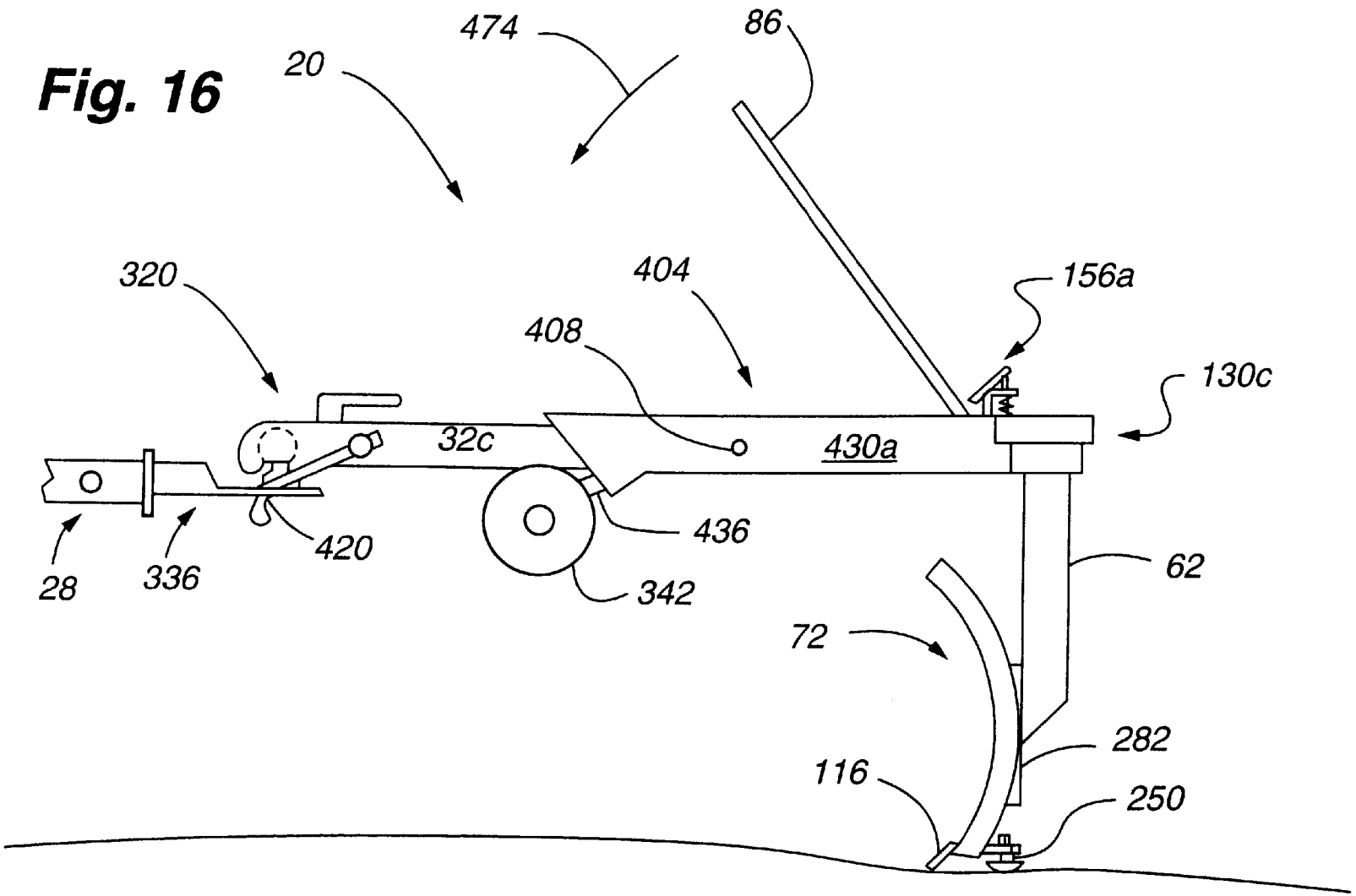
FIG. 16 shows the embodiment of the snowplow 20 also shown in FIGS. 14 and 15, wherein the blade 72 is in a fully lowered position.

FIGS. 15 and 16 illustrate different configurations for the embodiment of the snowplow 20 also shown in FIGS. 14 and 17. In particular, FIG. 15 illustrates an intermediate position that can be temporarily obtained when transitioning the snowplow 20 between the configuration of FIG. 14 wherein the blade is raised, and the configuration of FIG. 16, wherein the blade 72 is in a lowered position. That is, in transitioning from the configuration of FIG. 14 to the configuration of FIG. 16, a user may supply manual force on the fulcrum 86 in the direction of arrow 470 for thereby pivoting the pivotal support assembly 404 in a clockwise direction so that the tire assemblies 342 retract from the ground and the blade 72 (or more precisely, the skids 250) contact the ground in preparation for plowing. Alternatively, the configuration of FIG. 15 is also attained in transitioning from the configuration of FIG. 16 to that of FIG. 14. That is, a user supplying manual force in the direction of arrow 474 (FIG. 16), can cause the pivotal support assembly 404 to rotate about the shaft 408 until the tire assemblies 342 contact the ground and concurrently raise the blade. Note that it is an aspect of the present invention that the amount of force required on the fulcrum 86 to raise and/or lower the blade 72 can be provided easily by an average adult male or female. For example, a force in the range of 5 to 120 lbs. is sufficient for raising the blade 72. Further note that in performing the raising of the blade and the concurrent lowering of the wheel assembly 342, a latch or pin (not shown) for securing the pivotal support assembly 404 in the position shown in FIG. 16 may be first released to thereby allow the counterclockwise pivoting of the blade 72 and the tire assemblies 342.

Figure 18:
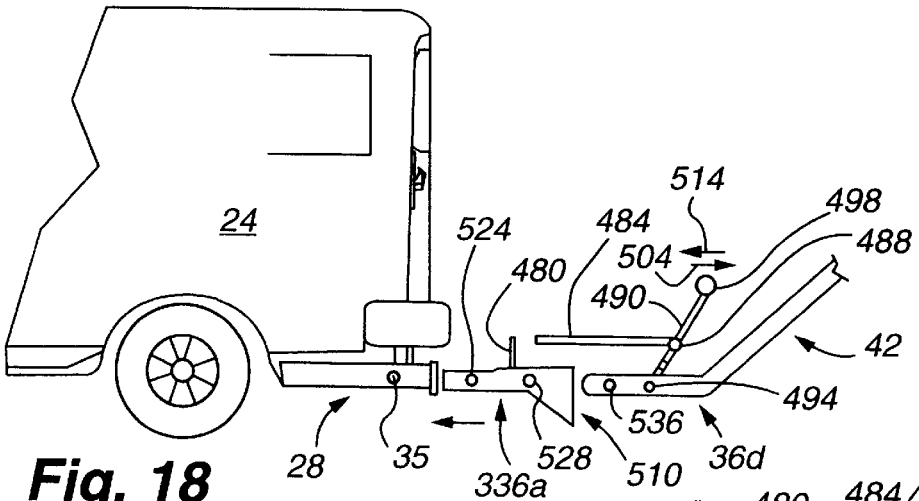
FIG. 18 an embodiment of a trailer hitch adapter 336*a* and slidable arm 484 for assisting in connecting the snowplow 20 to the vehicle 24.
Figure 20:
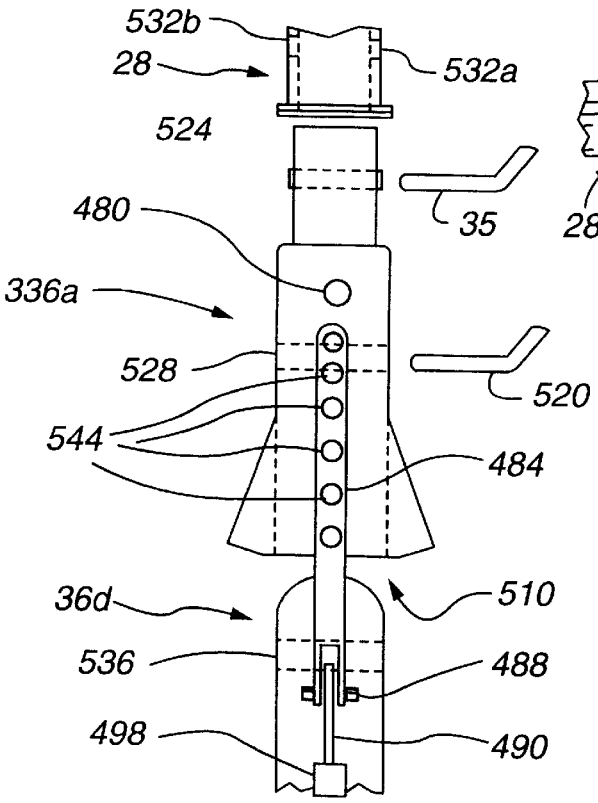
FIG. 20 shows a top view of the trailer hitch adapter 336*a* and the slidable arm 484 and lever.
Figure 21:
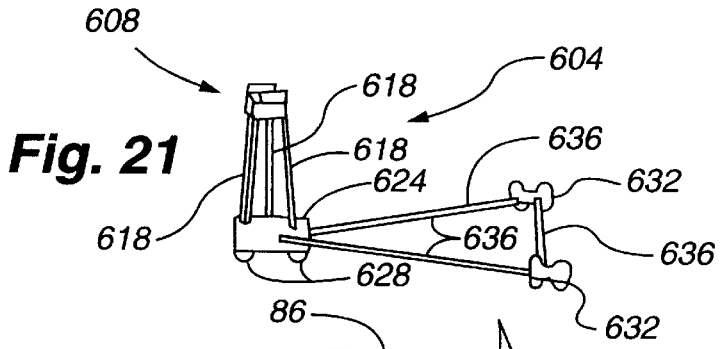
FIG. 21 shows a perspective view of a portable support 604 for the snowplow 20.

In a further aspect of the present invention, the snowplow 20 includes a novel trailer hitch adapter 336*a* (FIG. 18) and corresponding horizontal vehicle attachment portion 36*d* of the snowplow 20. Among the novel features of the trailer hitch adapter 336*a* and attachment portion 36*d* is a post 480 projecting from a top surface of the trailer hitch adapter 336*a* and a slidable arm 484 that is pivotally attached at pivot point 488 to a lever 490 for moving the slidable arm in substantially a horizontal direction toward or away from the post 480. In particular, the lever 490 pivots about a pivot point 494 within the horizontal vehicle attachment portion 36*d* so that when a user moves the free end 498 of the lever 490, the slidable arm 484 moves either toward or away from the post 480. Further, if the slidable arm is attached to the post 480, then user-applied force in the direction of arrow 504 urges the free end of the attachment portion 36*d* into the open end 510 of the trailer hitch adapter 336*a*. Conversely, if the slidable arm 484 is attached to the post 480 and the user exerts force in the direction of arrow 514, then this force induces a substantially opposite force between the trailer hitch 336*a* and the free end of the horizontal vehicle attachment portion 36*d* for disengaging these two components. Referring to FIG. 20, a top-view of the trailer hitch adapter 336*a* and both the slidable arm 484 and the lever 490 are shown. Additionally, note that pins 35 and 520 along with their mating bores 524 and 528, respectively, are shown. Note that the pin 35 is for securing the trailer hitch adapter 336a within the trailer hitch sleeve 28 when the bore 524 is aligned with the openings 532*a* and 532*b* in the wall of the trailer hitch sleeve 28. Additionally, note that the pin 520 is used to secure the free end of the horizontal vehicle attachment portion 36*d* within the trailer hitch adapter 336*a*. That is, when the free end of the horizontal vehicle attachment portion 36*d* is received within the trailer hitch adapter 336*a* so that the channel 536 that pierces the attachment portion 36*d* is aligned with the bore 528, the pin 520 may be inserted through both the channel and the bore to secure the snowplow 20 within the trailer hitch adapter 336*a*.

Figure 19:
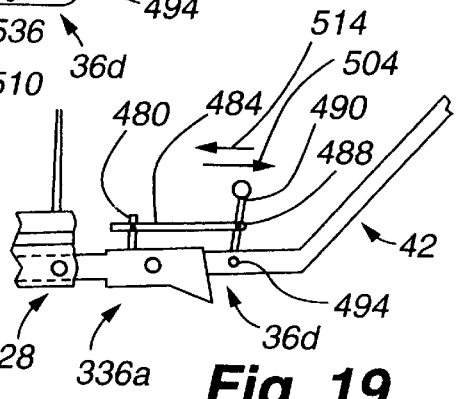
FIG. 19 illustrates another embodiment of the slidable arm and associated lever 490 for attaching the snowplow 20 to the vehicle 24.

Still referring to FIG. 20, note that the slidable arm 484 includes a series of holes 544 along the length of the slidable arm. These holes 544 are of sufficient diameter so that the post 480 can be received through any one of the holes for securing the slidable arm to the post as shown in FIG. 19. Thus, the slidable arm and the post can be secured together at a plurality of different distances along the slidable arm.

It is an important aspect of the trailer hitch adapter 336*a* that the open end 510 is flared both vertically and/or horizontally so that the free end of the attachment portion

36*d* can be more easily aligned and provided within the trailer hitch adapter 336*a*.

In operation, once a user has secured the trailer hitch adapter 336*a* to the trailer hitch sleeve 28 via the pin 35, the user can position the snowplow 20 so that the free end of the attachment portion 36*d* is roughly aligned with the open end 510. Subsequently, by providing the lever 490 in a forward position wherein its free end 498 is moved toward the back of the vehicle 24, the user may align one of the holes 544 with the post 480 for thereby securing the two together. Following this, the user can then apply force on the lever 490 in the direction of arrow 504 to thereby urge the free end of the attachment portion 36*d* further into the open end 510. Depending on the degree of alignment, friction, and/or obstructions within the open end 510, the user may need to repeat the above lever movements with the post 480 secured to a different hole 544 of the slidable arm 484 to further force the free end of the attachment portion 36*d* into the open end 510 until the channel 536 aligns with the bore 528 so that the pin 520 may be inserted for securing the trailer hitch adapter 336*a* to the attachment portion 36*d*.

Alternatively, the lever 490 may be employed without the trailer hitch adapter 336*a*. In this alternative embodiment, the lever 490 is capable of being temporarily secured to a part of the vehicle 24 or directly to the vehicle trailer hitch sleeve 28 by arm 484, this arm being modified with appropriate bins so that it is suitable for engaging another structure attached to either the vehicle or the vehicle trailer hitch sleeve. Accordingly, in operation, this alternative embodiment may be used in a manner similar to the embodiment immediately above. That is, a user provides force on the free end 498 of the lever 490 thereby causing the free end of the attachment portion 36*d* to slide into the trailer hitch sleeve 28 so that the pin 35 may be inserted to attach the snowplow 20 securely to the vehicle 24.

Figure 22:
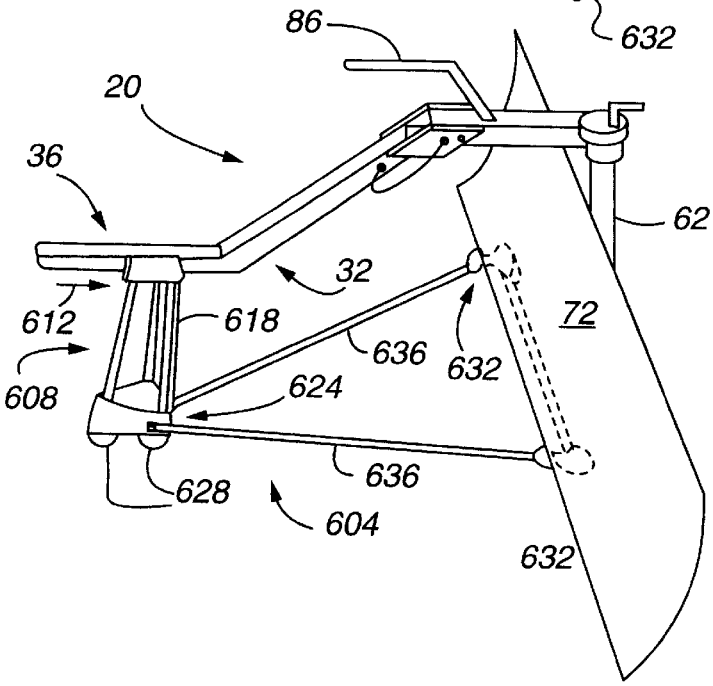
FIG. 22 shows a perspective view of the portable support 604 with an embodiment of the snowplow 20 thereon.

FIGS. 21–24 illustrate another aspect of the present invention wherein a portable support 604 (FIG. 21) is provided for transporting the snowplow 20 to the vehicle 24 for attachment and for transporting the snowplow from the vehicle 24 to storage. FIG. 22 illustrates how an embodiment of the snowplow 20 can be mounted on the portable support for transporting. That is, a front-wheeled portion 608 has a top bracket 612 in which the attachment portion 36 of the snowplow 20 can be laid and/or secured. Additionally, the front-wheeled portion includes spacer bars 618 for retaining the top bracket at a height that is approximately the same height as, for example, the trailer hitch sleeve 28 into which the attachment portion free end is to be received. Note that the spacer bars 618 may be adjustable so that its height can be adjusted so that its height is substantially the same as the height of the trailer hitch sleeve 28, and subsequently, the height can be reduced so that the portable support 604 can be easily removed from underneath the snowplow 20 once the snowplow is attached to the vehicle 24. Additionally, note that the base 624 of the front-wheeled portion provides the support for the spacer bars 618 and in addition this base also includes wheels 628 for allowing easy transport of the snowplow 20. However, not that, in an alternative embodiment, the wheel 628 may be replaced with skids. In the present embodiment, the base is triangular and accordingly, there are preferably three wheels 628 provided for rolling the front wheeled portion 608 along the ground, these wheels being at approximately each vertex of the base 624. However, other configurations and sizes of wheels are within the scope of the present invention. Thus, one or more larger wheels or tire assemblies may also be used. Additionally, the portable support 604 includes two snowplow blade rests 632 that are attached to one another and to the front-wheeled portion 608 by, for example, attachment bars 636 that attach between the blade rests 632, and between the blade rests 632 and the front-wheeled portion 608. Accordingly, as FIG. 22 illustrates, the snowplow 20 shown herein may be mounted upon the front-wheeled portion 608 to be transported to and from a vehicle 24 that is used for towing the snowplow 20. That is, a user can manually transport the snowplow 20 on the portable support 604 to the rear of his/her vehicle, secure the free end of the attachment portion 36 into trailer hitch sleeve 28, and dismount the snowplow 20 from the portable support 604. In particular, note that the front-wheeled portion 608 may be capable of varying the height of the top bracket 612 for mounting and/or dismounting the snowplow 20 when attaching or detaching the snowplow from a vehicle 24. Alternatively, the portable support 604 may be of substantially simple and rigid construction (e.g., the attachment bars composed of steel or some other rigid material so that the portable support is all that is required for transporting the snowplow 20 to and from the rear of a vehicle 24. Accordingly, since the snowplow 20 is capable of being lifted without undue stress by a typical adult and/or adolescent (the snowplow 20 having a weight of in the range of 35 to 120 lbs., once the snowplow 20 has been provided at the rear of the vehicle 24, a user can lift the snowplow 20 off the portable support 604 and attach it to the rear of a vehicle. Similarly, when the user is finished plowing, the user can then detach the snowplow 20 from the vehicle 24 and hoist it onto the portable support 604. Accordingly, the portable support 604 is designed to facilitate aligning the snowplow 20 with the vehicle attachment component, and to reduce the lifting of the snowplow by the user.

Figure 23:
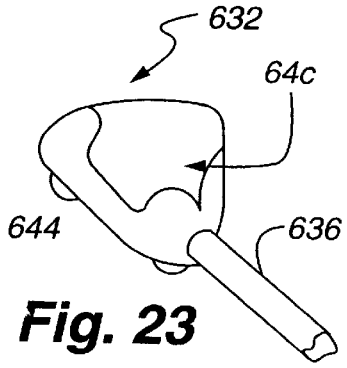
FIG. 23 shows a more detailed view of one of the blade rests 632 of the portable support 604.
Figure 24:
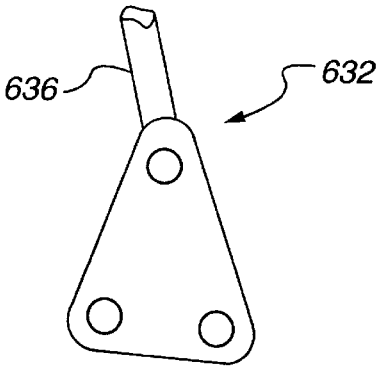
FIG. 24 shows the bottom of a blade rest 632.

FIGS. 23 and 24 provide more detailed views of the blade rests 632 of the portable support 604. In particular, FIG. 23 shows a perspective view of one of the blade rests 632 from a perspective view, wherein the blade is intended to rest in the slot 640. Accordingly, the blade rest 632 has a front knob 644 that prevents the edge of the blade 72 from slipping off of the front of the blade rest. Referring to FIG. 24, note that the bottom of a blade rest 632 is shown wherein there are three toes provided thereon for sliding the portable support 604 across the ground. Note that each of the toes and in some embodiments, each blade rest 632 is made entirely from plastic. Accordingly, the portable support 604 can be very lightweight and inexpensive to manufacture.

Since the embodiments above of the present invention are intended to be manually adjustable weight and overall dimensions are important aspects of the invention. In particular, the weight of the invention may be in the range of 35 to 120 lbs., with the horizontal length of the support member 32 being in the range of 2 to 10 feet.

It is also important to note that the present invention, with appropriate modification, may also be used for clearing brush, tiling soil, aerating soil, etc. Essentially, to perform these additional tasks, the primary modification to the embodiment hereinabove is that the blade 72 is replaced by a tool appropriate for the task. Thus, for clearing brush, a heavy-duty rake may be installed as a replacement for the blade 72, and for tilling soil, a tool having a series of soil knives may be used.

The foregoing discussion of the invention has been presented for purposes of illustration and description. Further, the description is not intended to limit the invention to the form disclosed herein. Consequently, variation and modification commensurate with the above teachings, and within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A snowplow, comprising:

a blade for displacing snow said blade having a front and back surface, said front surface being for accumulating snow to be displaced;

a blade attaching support for operatively connecting said blade to a rear of a vehicle for towing said blade said blade attaching support having first and second portions, said first portion being for attaching to said vehicle and said second portion having said blade attached thereto, wherein said first and second portions are moveable with respect to one another such that said blade is capable of being moved between a raised position wherein said blade is not capable of plowing snow, and a lowered position wherein said blade is capable of plowing snow;

a fulcrum attached to said support for manually moving said blade between said raised position and said lowered position, said blade moved respectively between said raised and lowered positions by manual force alone; and wherein said blade attaching support includes a pivotable lever and a slidable arm attached thereto so that when said slidable arm is operatively attached to said vehicle, said lever is capable of being moved so that said first portion is one of: more securely attached to said vehicle and less securely attached depending on a direction of movement of said lever.

2. A snowplow as claimed in claim 1, wherein said first and second portions are pivotally-attached to one another and said fulcrum is attached to said support so that said first and second portions are capable of being manually pivoted with respect to one another so that said blade is moved between said raised position and said lowered position.

3. A snowplow as claimed in claim 2, wherein said fulcrum includes a portion that is above said pivot when said blade is in said lowered position.

4. A snowplow as claimed in claim 1, wherein at least one of said first and second portions extend above said blade when said blade is in said lowered position.

5. A snowplow as claimed in claim 1, wherein said first portion includes a support member having an angled portion and a vehicle attachment portion, said angled portion operatively connecting said blade to said vehicle attachment portion, and said vehicle attachment portion is capable of being attached to said vehicle;

wherein when said vehicle attachment portion is attached to said vehicle, said angled portion includes an extent that rises above a height of said blade when said blade is in said lowered position.

6. A snowplow as claimed in claim 1, further including means for securing said blade in at least one of said raised position and said lowered position.

7. A snowplow as claimed in claim 6, wherein said means for securing includes one of a latch and a dog for securing said blade in one of said raised position and said lowered position.

8. A snowplow as claimed in claim 1, wherein said second portion includes a rotatable member for rotating said blade so that said front surface is capable of facing substantially away from said vehicle.

9. A snowplow as claimed in claim 1, wherein said second portion includes a means for changing an angle of said blade so that one end of said blade trails further behind said vehicle than another end of said blade.

10. A snowplow as claimed in claim 1, wherein said second portion includes an insert moveably provided in one or more recesses on said back surface so that an edge of said blade adjacent an extent of ground is capable of being angled to conform to a difference in height between ground areas underneath said edge.

11. A snowplow as claimed in claim 10, wherein said insert includes a substantially planar plate slidably provided in two slots, wherein said plate can slide within said slots in two different directions.

12. A snowplow as claimed in claim 1, wherein said blade includes one or more ground spacing attachments adjacent an edge of said blade, wherein said ground spacing attachments space said edge from the ground.

13. A snowplow as claimed in claim 12, wherein one of said ground spacing attachments includes one of a skid and a wheel.

14. A snowplow as claimed in claim 13, wherein one of said ground spacing attachments includes both a skid and a wheel, wherein said ground spacing attachment is capable of having said skid contact the ground in a first configuration and having said wheel contact the ground in a second configuration.

15. A snowplow as claimed in claim 1, wherein said blade attaching support includes one or more tires so that when said blade is in said raised position, said one or more tires support said snowplow, and when said blade is in said lowered position, said one or more tires do not support said snowplow.

16. A snowplow, comprising:

a blade for displacing snow, said blade having a front and back surface, said front surface being for accumulating snow to be displaced;

a blade attaching support for operatively connecting said blade to a rear of a vehicle for towing said blade, said blade attaching support having first and second portions, said first portion being for attaching to said vehicle and said second portion having said blade attached thereto, wherein said first and second portions are moveable with respect to one another such that said blade is capable of being moved between a raised position wherein said blade is not capable of plowing snow, and a lowered position wherein said blade is capable of plowing snow;

a fulcrum attached to said support for manually moving said blade between said raised position and said lowered position, said blade moved respectively between said raised and lowered positions by manual force alone; and a trailer hitch adapter for connecting between a trailer hitch of said vehicle and said blade attaching support, wherein said adapter includes an open end for receipt of a free end of said blade attaching support into an interior of said adapter and said blade attaching support includes a pivotable lever and slidable arm attached thereto so that when said slidable arm is attached to said adapter, said lever is capable of being moved so that said free end moves relative to said interior.

17. A snowplow as claimed in claim 1, further including a portable support, said portable support includes:

a blade carrying means for supporting said blade above the ground, said blade carrying means supporting said blade adjacent the ground when said blade is in said lowered position;

a support carrying means for carrying said blade attaching support;

wherein said blade carrying means and said support carrying means each include one of: skids and wheels for transporting said snowplow on said portable support.

18. A snowplow, as claimed in claim 1, wherein said plow has a weight in a range of 35 to 120 lbs.

19. A snowplow, as claimed in claim 1, wherein said fulcrum is attached to said second portion at a height that is higher than said blade when said blade is in said lowered position.

20. A snowplow, as claimed in claim 1, wherein said fulcrum has an adjustable length.

21. A snowplow, as claimed in claim 1, wherein said fulcrum is fixedly attached to said second portion.

22. A snowplow, comprising a blade for displacing snow said blade having a front and back surface, said front surface being for accumulating snow to be displaced;

a blade attaching support for operatively connecting said blade to a rear of a vehicle for towing said blade, said blade attaching support having first and second portions, said first portion being for attaching to said vehicle and said second portion having said blade attached thereto, wherein said first and second portions are moveable with respect to one another such that said blade is capable of being moved manually between a raised position wherein said blade is not capable of plowing snow, and a lowered position wherein said blade is capable of plowing snow;

wherein said blade attaching support and said blade each have members that slidably cooperate with one another so that lateral ends of said blade are capable of following terrain contours having different elevations and wherein said blade attaching support includes a pivotable lever and a slidable arm attached thereto so that when said slidable arm is operatively attached to said vehicle, said lever is capable of being moved so that said first portion is one of: more securely attached to said vehicle and less securely attached depending on a direction of movement of said lever.

* * * * *